United States Patent [19]

Klötzer et al.

[11] Patent Number: 4,705,747

[45] Date of Patent: Nov. 10, 1987

[54] COLOR PHOTOGRAPHIC RECORDING MATERIAL CONTAINING A SILVER HALIDE EMULSION AND A PROCESS FOR ITS PRODUCTION

[75] Inventors: Sieghart Klötzer, Cologne; Bruno Mücke; Günther Mahlberg, both of Bergisch Gladbach; Manfred Becker, Leverkusen, all of Fed. Rep. of Germany

[73] Assignee: Agfa Gevaert Aktiengesellschaft, Leverkusen, Fed. Rep. of Germany

[21] Appl. No.: 832,432

[22] Filed: Feb. 24, 1986

[30] Foreign Application Priority Data

Mar. 6, 1985 [DE] Fed. Rep. of Germany ..... 3507830

[51] Int. Cl.[4] ..... G03C 1/06; G03C 1/40; G03C 1/02

[52] U.S. Cl. ..... 430/550; 430/569; 430/538; 430/605; 430/564; 430/543

[58] Field of Search ..... 430/569, 605, 550, 538, 430/564, 543

[56] References Cited

U.S. PATENT DOCUMENTS

| | | | |
|---|---|---|---|
| 4,298,683 | 11/1981 | Becker et al. | 430/569 |
| 4,469,783 | 9/1984 | Kuwabara et al. | 430/569 |
| 4,469,784 | 9/1984 | Heki et al. | 430/569 |

*Primary Examiner*—Won H. Louie
*Attorney, Agent, or Firm*—Connolly & Hutz

[57] ABSTRACT

Improved silver halide emulsions are obtained by the combined use of an iridium compound and an imidazole before termination of crystal growth.

7 Claims, 2 Drawing Figures

Figure 1:
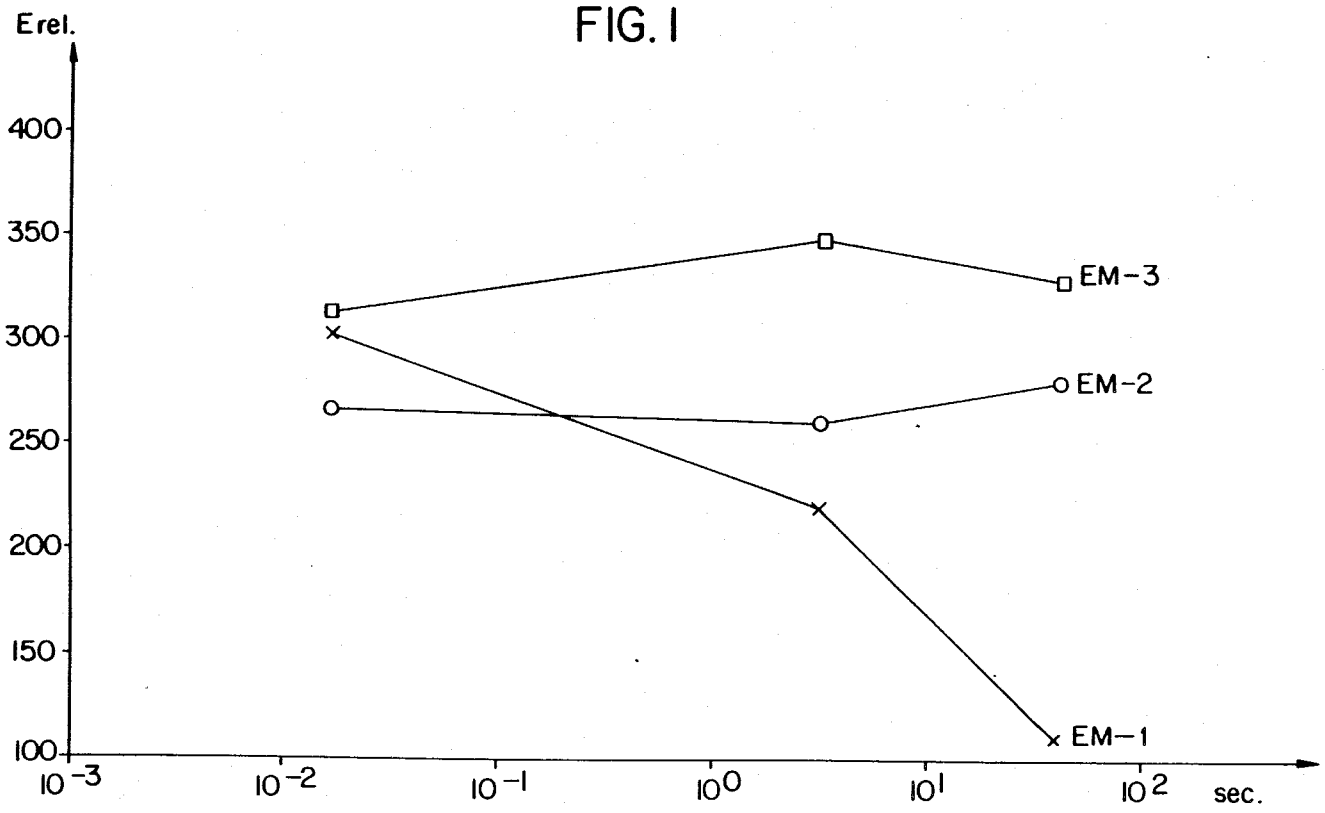

COLOR PHOTOGRAPHIC RECORDING MATERIAL CONTAINING A SILVER HALIDE EMULSION AND A PROCESS FOR ITS PRODUCTION

This invention relates to a color photographic recording material containing a silver halide emulsion and to a process for producing this silver halide emulsion. The recording materials according to the invention are distinguished by improved properties, particularly in regard to sensitivity, fogging and susceptibility to pressure.

It is already known that the sensitometric properties of photographic silver halide emulsions can be improved by the addition of certain auxiliaries, for example organic compounds or metallic compounds, not only after, but also before termination of crystal growth. For example, it is known that thioethers and imidazole derivatives may be used to control seed count where silver halide emulsions are used. For example, it is known from U.S. Pat. No. 3,574,628 that emulsions may be prepared in the presence of a thioether. However, the disadvantage of using thioethers in the precipitation of photographic emulsions is, in particular, that thioethers are difficult to prepare in pure form and may contain undesirable impurities. Another disadvantage is the instability of thioethers, particularly in the presence of silver ions. The products formed in the event of decomposition of thioethers can cause undesirably heavy fogging, particularly during subsequent chemical ripening.

It is also known that iridium compounds may be added not only for chemical ripening, but even before termination of crystal growth.

The addition may be made for reasons of stabilization and fog improvement, cf. for example U.S. Pat. Nos. 2,566,243 and 2,566,263.

It is also known that iridium salts may be added to the emulsions to improve the reciprocity error. In this case, sensitivity is generally only improved with short exposure times, cf. DE-Pat. No. 2 611 037. The iridium salts are added either during precipitation of the silver halide, so that iridium ions are incorporated in the crystal lattice of the silver halide, or during the chemical ripening process. According to DE-Pat. Nos. 2 063 669 and 2 165 764, optical sensitizers are used in addition to iridium salts.

The increasing of sensitivity with normal exposure times by adding iridium salts both during precipitation and also during chemical ripening is described by Bahnmuller in Phot. Korrespondenz 9 (1968), pages 173 et seq. In this case, a slight increase in sensitivity is obtained by addition of iridium during precipitation.

Neither emulsions doped solely with iridium nor emulsions prepared solely with thioether are able to satisfy the demands imposed on modern emulsions in color materials, particularly color papers, in regard to stability of gradation and sensitivity for maximal sensitivity over a wide exposuretime range (between 20/1000 sec. and 150 secs.). Further disadvantages of these emulsions include their sensitivity to pressure and changes of gradation depending on processing conditions. In certain cases, this leads to undesirable tinges of color in the color images.

In addition, U.S. Pat. No. 4,469,783 describes silver halide emulsions which are prepared in the presence of a water-soluble iridium compound and additionally in the presence of a thiourea or an organic thioether. This is said to improve sensitivity, gradation and fogging. The described emulsions are used for the production of dot images. There is no mention of their use in color photographic recording materials.

One object of the present invention is to provide new color photographic recording materials having improved sensitometric properties.

A color photographic recording material containing at least one photosensitive silver halide emulsion layer and, optionally, other layers on a layer support has now been found. According to the invention, the silver halide emulsion of the silver halide emulsion layer contains silver halide crystals of which the crystal formation and/or crystal growth was carried out at least partly in the presence of an iridium compound and an imidazole.

The use of imidazoles in the formation of silver halide crystals is already known per se from DE-Pat. No. 27 58 711. However, the same does not apply to the combined use of imidazoles with iridium compounds before termination of crystal growth.

Surprisingly, the recording materials according to the invention combine low fogging with high sensitivity, steep gradation and outstanding stability of sensitivity and gradation over an exposure time range of from at least 20/ 1000 sec. to 150 secs. and, in addition, are not sensitive to pressure. This is surprising because emulsions containing iridium alone do not have the properties described above. Even emulsions precipitated in the presence of imidazoles, but in the absence of iridium compounds, do not achieve the values obtainable in accordance with the invention.

Particularly advantageous imidazoles correspond to the following general formula

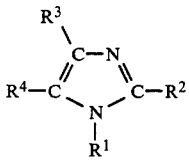

(I)

in which $R^1$, $R^2$, $R^3$ and $R^4$ may be the same or different and represent hydrogen and/or optionally substituted alkyl, alkenyl, aryl and/or aralkyl groups.

Preferred alkyl groups contain from 1 to 8 carbon atoms and more especially from 1 to 4 carbon atoms, such as for example methyl and ethyl.

Suitable alkenyl groups are those containing from 3 to 8 carbon atoms, for example allyl, butenyl, hexenyl or octenyl. Preferred alkenyl groups contain from 3 to 4 carbon atoms, the allyl group being particularly preferred.

Suitable aryl substituents are those containing from 6 to 12 carbon atoms, for example phenyl, biphenyl or naphthyl. The preferred aryl substituent is the phenyl group.

Araliphatic substituents may be those containing from 1 to 2 carbon atoms in the aliphatic portion and from 6 to 12 carbon atoms in the aromatic portion, for example benzyl and phenylethyl.

Suitable substituted alkyl groups are, for example, hydroxy, cyano, alkoxy, free or esterified carboxy and/or sulfozlkyl groups. The compounds used in accordance with the invention are preferably soluble in water.

Examples of particularly suitable compounds are shown in Table 1 below:

TABLE 1

| Compound No. | Compound |
|---|---|
| 1 | imidazole |
| 2 | 1-methylimidazole |
| 3 | 2-methylimidazole |
| 4 | 1,2-dimethylimidazole |
| 5 | 1-allylimidazole |
| 6 | 1-methoxymethylimidazole |
| 7 | 1-(2-carboxyethyl)-imidazole |
| 8 | 4-(or 5-)methylimidazole |
| 9 | 2-ethyl-4-methylimidazole |

The imidazole compounds used in accordance with the invention may be added to the emulsion at any stage during their preparation. According to the invention, they are preferably added to the receiving medium in which the silver halide is precipitated. In addition, they may also be added, for example, to (a) the starting solution containing silver ions, i.e. generally the silver nitrate solution;

(b) the halide-containing starting solution.

During precipitation of the emulsion, the protective colloid (particularly gelatin) may be present not only in the receiving medium, but also in the inflowing halide solution.

The imidazoles suitable for use in accordance with the invention may be used in a very wide concentration range. the concentration in which they are used depends upon the required end size of the silver halide crystals and may range from $10^{-4}$-molar solution to the saturation limit of the compound. They are preferably used in 0.003-molar to 1-molar solution.

Suitable iridium compounds are, in particular, water-soluble iridium salts and complex compounds. Particularly suitable iridium compounds are, for example, iridium trichloride, iridium tetrachloride and also trivalent and tetravalent hexachloroiridates of sodium, potassium and ammonium.

The iridium compounds used in accordance with the invention may be added to the emulsion at any stage during its preparation either independently of the addition of the imidazole or together therewith. It is particularly preferred to use the iridium compounds in quantities of from $10^{-10}$ to $10^{-4}$ moles per mole of silver halide and more especially in quantities of from $10^{-8}$ to $10^{-6}$ moles.

The pH-value prevailing during preparation of the emulsions is generally $>4$ and preferably in the range from pH 5.5 to pH 6.5, although alkaline pH-values are also possible.

The pH-value may even be changed during precipitation. In particular, the silver halide seeds may be precipitated at pH$>5$ and then allowed to continue growing at pH$<5$ into larger silver halide crystals.

The pAg-value prevailing during preparation of the emulsions may be varied over a wide range. Depending on the desired crystal habit, precipitation of the emulsions may be carried out at pAg values at which cubic or octahedral surface growth is preferred. In one special embodiment, the pAg value may even be changed during precipitation.

Substances of the type normally used as ripening agents may also be present during precipitation. Examples of substances such as these include compounds of sulfur, selenium, tellurium, gold, palladium, platinum, thiourea derivatives, formamidine sulfinic acid, tin(II)-chloride.

Divalent and/or polyvalent cations, such as for example $La^{3+}$, $Zn^{2+}$, $Pb^{2+}$, $Tl^{3+}$, $Co^{2+}$, $Rh^{3+}$, etc., may also be present during the precipitation.

The precipitation temperature is best between 30° and 90° C. The temperature may even be changed during the precipitation process, for example the seeds may be formed at elevated temperature and the rest of the crystal growth process subsequently continued at a lower temperature, as described for example in U.S. Pat. No. 3,790,387.

Silver halide emulsions may contain any of the silver halides which are commonly used in silver halide photography, such as for example silver chloride, silver bromide, silver chloride bromide, silver chloride bromide iodide, silver chloride iodide and silver bromide iodide.

In one preferred embodiment, the silver halide emulsions used in accordance with the invention contain at least 20 mole % of silver chloride, less than 80 mole % of silver bromide and at most 5 mole % of silver iodide.

In one preferred embodiment, the crystals are predominantly compact crystals which are, for example, cubic or octahedral or have transitional forms. They may be characterized by the fact that they mostly have a thickness of greater than 0.2 μm. The average ratio of diameter to thickness is preferably less than 8:1, the diameter of a crystal being defined as the diameter of a circle with an area corresponding to the projected area of the crystal. In another preferred embodiment, however, all the emulsions or individual emulsions may even contain substantially tablet-form silver halide crystals in which the ratio of diameter to thickness is greater than 8:1.

In one embodiment of the invention, the emulsion has a narrow particle size distribution in which at least 95% by weight of the crystals have a diameter which differs by no more than 40% from the mean crystal diameter. However, the emulsions may also have a wide particle size distribution in which at least 10% and preferably 20% of the silver halide crystals have a diameter which differs by at least 40% from the mean crystal diameter.

The silver halide emulsions may be produced by any of the standard methods (for example single inflow, dual inflow, with constant or variable inflow). The dual-inflow process with control of the pH value is particularly preferred, reference being made in this connection to the journal Research Disclosure No. 17643 of December, 1978, Sections I and II, published by Industrial Opportunities Ltd., Homewell Havant, Hampshire, PO9 1 EF, Great Britain. In another preferred embodiment, the silver halide emulsions may be prepared by the dissolving and crystallizing process described, for example, in DE-Pat. No. 28 28 112.

The silver halide crystals may also have a layered crystal structure of a core and at least one shell, as known for example from GB-Pat. No. 1 027 146. The core and shell may have the same or different halide composition. The core may consist of 100% AgCl, 100% AgBr or of intermediate mixtures and corresponding fractions of AgI.

The emulsions are chemically sensitized, preferably at the crystal surface, to a high surface sensitivity. They may be chemically sensitized by known methods, for example with active gelatin or with compounds of sulfur, selenium, tellurium, gold, palladium, platinum, iridium, the pAg values being variable from 4 to 10, the pH values from 3.5 to 9 and the temperatures from 30° C. to 90° C. Chemical sensitization may be carried out in the presence of heterocyclic nitrogen compounds, such as imidazoles, azaindenes, azapyridazines and azapyrimidines and thiocyanate derivatives, thioethers and other silver halide solvents. Instead or in addition, the emulsions according to the invention may be subjected to reduction sensitization, for example by hydrogen, by a low pAg value (for example below 5) and/or a high pH value (for example above 8), by reducing agents, such as tin (II) chloride, thiourea dioxide and aminoboranes. The surface-ripe crystals may even exist as troglodyte seeds (sub-surface seeds) according to DE-OS Pat. No. 2 306 447 and U.S. Pat. No. 3,966,476. The crystals may even be internally ripened. Other methods are described in the above-mentioned Research Disclosure No. 17643, Section III.

The emulsions may be optically sensitized in known manner, for example with the usual polymethine dyes, such as neutrocyanines, basic or acidic carbocyanines, rhodacyanines, hemicyanines, styryl dyes, oxonols and the like. Sensitizers such as these are described by F. M. Hamer in "The Cyanine Dyes and Related compounds", (1964). Particular reference in this connection is made to Ullmanns Enzylklopadie der technischen Chemie, 4th Edition, Vol. 18, pages 431 et seq and to the above-mentioned Research Disclosure No. 17643, Section IV.

The usual antifogging agents and stabilizers may be used. Particularly suitable stabilizers are azaindenes, preferably tetra- or pentaazaindenes, especially those substituted by hydroxyl or amino groups. Compounds such as these are described, for example, inthe article by Birr in Z. Wiss. Phot. 47, (1952), pages 2 to 58. Other suitable stabilizers and antifogging agents are described in the above-mentioned Research Disclosure No. 17643, Section IV.

Color couplers which react with color developer oxidation products to form a non-diffusing dye are preferably associated with the photosensitive silver halide emulsion layers. The color couplers are best accommodated in nondiffusing form either in or in close proximity to the photosensitive layer.

Thus, the red-sensitive layer may contain, for example, a non-diffusing color coupler for producing the cyan component color image, generally a coupler of the phenol or α-naphthol type. The green-sensitive layer may contain, for example, at least one non-diffusing color coupler for producing the magenta component color image, normally a color coupler of the 5-pyrazolone type. The blue-sensitive layer may contain, for example, at least one non-diffusing color coupler for producing the yellow component color image, generally a color coupler containing an open-chain ketomethylene group. The color couplers may be, for example, 6-, 4- or 2-equivalent couplers. Suitable couplers are known, for example, from the publications entitled "Color Couplers" by W. Pelz in "Mitteilungen aus den Forschungslaboratorien der Agfa, Leverkusen/Munchen", Vol. III, page 111 (1961), K. Venkataraman in "The Chemistry of Synthetic Dyes", Vol. 4, 341 to 387, Academic Press (1971) and T. H. James "The Theory of the Photographic Process", 4th Edition, pages 353 to 362 and also from the above-mentioned Research Disclosure, Section VII. In addition, the recording material may contain DIR compounds and white couplers which do not produce a dye on reaction with color developer oxidation products. The inhibitors releasable from the DIR compounds may be split off directly or via non-inhibiting intermediate compounds, cf. GB-Pat. No. 953 454, U.S. Pat. Nos. 3,632,345, 4,248,962 and GB-Pat. No. 2 072 363.

the constituents of the photographic material may be incorporated in the usual way. The materials according to the invention are used in conjunction with the usual layer supports, for example supports of cellulose esters, for example cellulose acetate, and of polyesters. Other suitable supports are paper supports which may optionally be coated, for example with polyolefins, more especially with polyethylene or polypropylene. Reference is made in this connection to the above-cited Research Disclosure No. 17643, Section XVII.

Suitable protective colloids or rather binders for the layers of the recording material are the usual hydrophilic film-forming agents, for example proteins, more especially gelatin. Reference is made in this connection to the binders described in the above-mentioned Research Disclosure No. 17643, Section IX.

The layers of the photographic material may be hardened in the usual way, for example with hardeners of the epoxide type, the heterocyclic ethylene imine type and the acryloyl type. The layers may also be hardened by the process according to DE-OS Pat. No. 2 218 009 in order to obtain color photographic materials which are suitable for high-temperature processing. It is also possible to harden the photographic layers or rather the color photographic multilayer materials with hardeners of the diazine, triazine or 1,2-dihydroquinoline series or with hardeners of the vinylsulfone type. Other suitable hardeners are known from DE-OS Pat. Nos. 2 439 551, 2 225 230 and 2 317 672 and from the above-mentioned Research Disclosure 17643, Section XI.

Other suitable additives are mentioned in Research Disclosure 17643 and in Product Licensing Index, December 1971, pages 107 to 110.

Suitable color developers for the material according to the invention are, in particular, those of the p-phenylene diamine type, for example 4-amino-N,N-diethylaniline hydrochlorides; 4-amino-3-methyl-N-ethyl-N-β-(methanesulfonamido)ethylaniline sulfate hydrate; 4-amino-3-methyl-N-ethyl-N-β-hydroxyethylaniline sulfate; 4amino-N-ethyl-N-(2-methoxyethyl)m-toluidine di-p-toluene sulfonic acid and N-ethyl-N-β-hydroxyethyl-p-phenylene diamine. Other suitable color developers are described, for example, in J.Amer.Chem.Soc. 73, 3100 (1951) and in G. Haist, Modern Photographic Processing, 1979, John Wiley and sons, New York, pages 545 et seq.

After color development, the material is bleached and fixed in the usual way. Bleaching and fixing may be carried out either separately from or together with one another. Suitable bleaches are the usual compounds, for example $FE^{3+}$ salts and $FE^{3+}$ complex salts, such as ferricyanides, dichromates, water-soluble cobalt complexes, etc. Particularly suitable bleaches are iron (III) complexes of aminopolycarboxylic acids, more especially for example ethylene diamine tetraacetic acid, nitrilotriacetatic acid, iminodiacetic acid, N-hydroxyethyl ethylene diamine triacetic acid, alkyliminodicarboxylic acids, and of corresponding phosphonic acids. Other suitable bleaches are persulfates.

EXAMPLE 1

The comparison emulsion EM-1 is prepared from the solutions described in detail in the following:

| | |
|---|---|
| Solution E-1: | |
| Distilled water | 7,000 ml |
| Gelatin | 100 g |
| N—methylimidazole | 11 g |
| Solution E-2: | |
| Distilled water | 3,000 ml |
| Potassium bromide | 200 g |
| Sodium chloride | 270 g |
| Solution E-3: | |
| Distilled water | 3,000 ml |
| Silver nitrate | 700 g |
| Solution E-4: | |
| Distilled water | 2,000 ml |
| Sodium chloride | 105 g |
| Solution E-5: | |
| Distilled water | 2,000 ml |
| Silver nitrate | 300 g |
| Solution E-6: | |
| Distilled water | 1,000 ml |
| Potassium bromide | 324 g |
| Solution E-7: | |
| Distilled water | 9,000 ml |
| Gelatin | 900 g |

The receiving medium, solution E-1, is heated to 55° C. and adjusted to pH 6.0. Solution E-2 similarly heated to 55° C. is then introduced with intensive mixing at a rate of 600 ml per minute.

Solutions E-3, E-4, E-5 and E-6 are then successively introduced at a uniform rate of 600 ml per minute. After a digestion time of 30 minutes at 55° C., the emulsion is cooled and subsequently freed from the soluble salts in the usual way by flocculation and washing. The washed flocculate is then redispersed in solution E-7 by stirring for 30 minutes at 40° C.

This emulsion is called EM-1 and has an average grain diameter of 0.48 μm.

Comparison Emulsion EM-2

Comparison EM-2 is prepared in the same way as EM-1 using the following solutions:

| | |
|---|---|
| Solution F-1: | |
| Distilled water | 7,000 ml |
| Gelatin | 100 g |
| Solution F-2: | |
| Distilled water | 3,000 ml |
| Potassium bromide | 200 g |
| Sodium chloride | 270 g |
| $Na_2IrCl_6.6H_2O$ | 10.1 mg |
| Solution F-3: | |
| Distilled water | 3,000 ml |
| Silver nitrate | 700 g |
| Solution F-4: | |
| Distilled water | 2,000 ml |
| Sodium chloride | 105 g |
| Solution F-5: | |
| Distilled water | 2,000 ml |
| Silver nitrate | 300 g |
| Solution F-6: | |
| Distilled water | 1,000 ml |
| Potassium bromide | 324 g |
| Solution F-7: | |
| Distilled water | 9,000 ml |
| Gelatin | 900 ml |

Comparison emulsion EM-2 is precipitated in the same way as in emulsion EM-1, except that the receiving medium, solution F-1, and solutions F-2 to F-6 were heated to 60° C.

Emulsion EM-3 according to the invention

The formulation for emulsion EM-3 according to the invention was the same as for emulsion EM-1, except that 10.1 mg of $Na_2IrCl_6.6\ H_2O$ were also added to solution E-2.

After the addition of 38 μmoles of sodium thiosulfate per mole of silver halide, emulsions EM-1 to EM-3 are digested for 120 minutes at 50° C.

Thereafter, quantities of 500 ml of a 0.5% methanolic solution of a spectral sensitizer for the green spectral region are added to the emulsions which are then digested for 30 minutes at a temperature of 56° C. Finally, 100 ml of a 1% solution of an azaindene stabilizer are added.

For sensitometric testing, the emulsions are cast onto a paper support together with a standard magenta coupler and, after exposure behind a gray wedge, are processed by the method described in DE-Pat. No. 3 107 173, pages 23 et seq.

The photographic testing of emulsions EM-1, EM-2 and EM-3 produced the results set out in Table 1 below.

TABLE 1

| Emulsions | E rel. | Gamma | Fogging |
|---|---|---|---|
| EM-1 (imidazole only; comparison) | 100 | 2.65 | 0.22 |
| EM-2 (iridium only; comparison) | 125 | 2.41 | 0.25 |
| EM-3 (imidazole + IR; invention) | 180 | 2.69 | 0.23 |

For comparable fogging, the emulsion EM-3 according to the invention is distinguished by steeper graduation and distinctly higher sensitivity.

Figure 2:
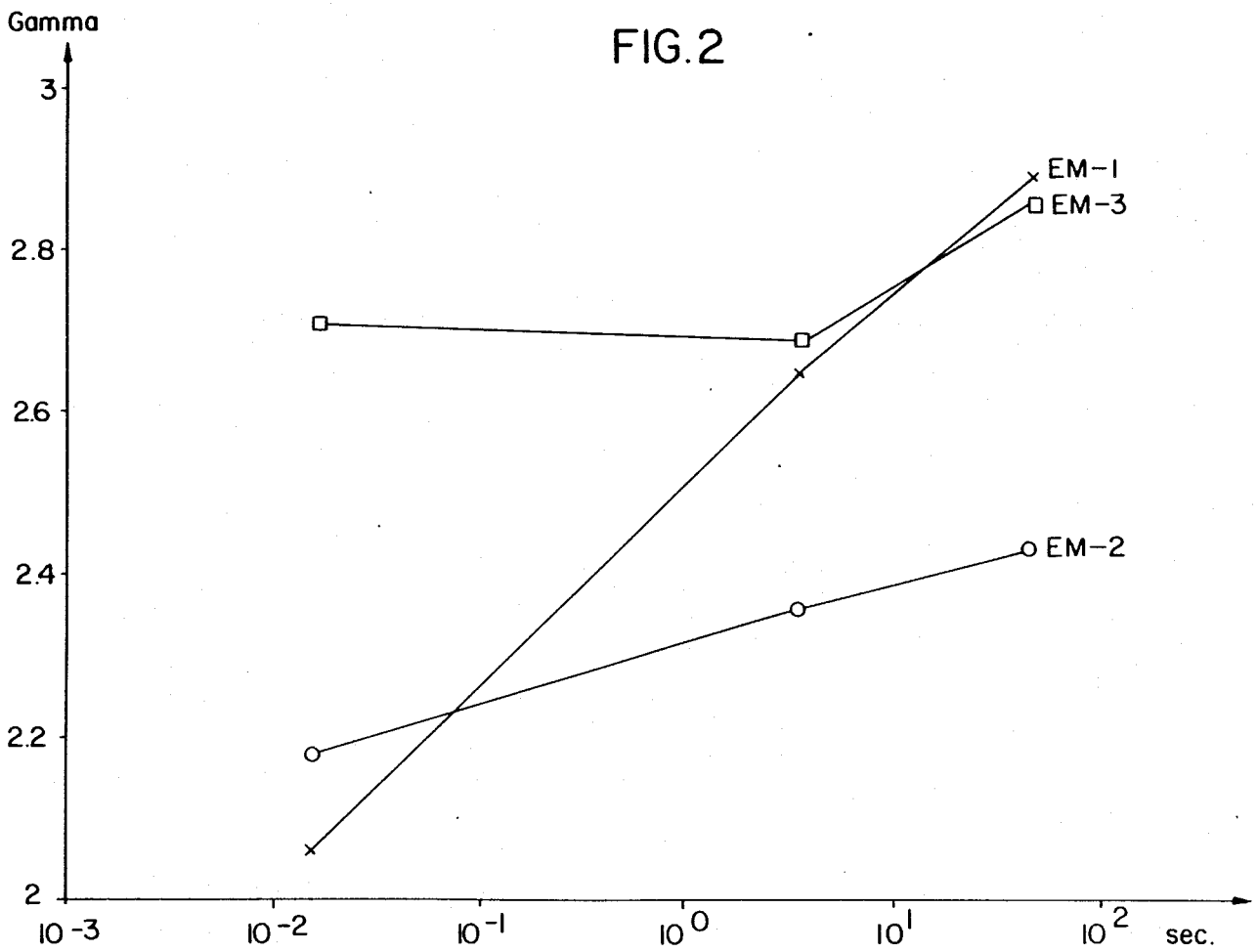

The dependence of sensitivity and gradation upon the exposure time is shown in FIGS. 1 and 2.

EXAMPLE 2

Comparison Emulsion EM-4

Comparison emulsion EM-4 is prepared from the following solutions:

| | |
|---|---|
| Solution K-1: | |
| Distilled water | 15,000 ml |
| Gelatin | 300 g |
| Sodium chloride | 290 g |
| Potassium bromide | 175 g |
| N—methylimidazole | 10 g |
| Hydrochloric acid 5 N | 20 ml |
| Solution K-2: | |
| Distilled water | 5,000 ml |
| Silver nitrate | 1,000 g |
| Solution K-3: | |
| Distilled water | 9,000 ml |
| Gelatin | 700 g |

The receiving medium, solution K-1, is heated to 55° C. and adjusted to pH 6.0. Solution K-2 similarly heated to 55° C. is added to solution K-1 in 10 seconds with intensive mixing. After digestion for 40 minutes at 55° C., the emulsion is cooled and subsequently freed from the soluble salts in the usual way by flocculation and washing.

The washed flocculate is then redispersed in solution K-3 by stirring for 30 minutes at 40° C.

The emulsion thus prepared is called EM-4 and has an average grain diameter of 0.26 μm; the halide composition is 75 mole % AgCl and 25 mole % AgBr.

Comparison Emulsion EM-5

The following solutions are used for preparing comparison emulsion EM-5:

| | |
|---|---|
| Solution L-1: | |
| Distilled water | 15,000 ml |
| Gelatin | 300 g |
| Sodium chloride | 290 g |
| Potassium bromide | 175 g |
| Hydrochloric acid, 5 N | 20 ml |
| $Na_2IrCl_6.H_2O$ | 10.1 mg |
| Solution L-2: | |
| Distilled water | 5,000 ml |
| Silver nitrate | 1,000 g |
| Solution L-3: | |
| Distilled water | 9,000 ml |
| Gelatin | 700 g |

Comparison emulsion EM-5 is precipitated in the same way as EM-4, except that the receiving medium, solution L-1, and solution L-2 are heated to 60° C. to obtain a comparable grain size even without silver halide solvents.

Emulsion EM-6 according to the invention

The formulation used for emulsion EM-6 according to the invention was the same as for emulsion EM-4, except that 10.1 mg of $Na_2IrCl_6.H_2O$ were also added to solution K-1.

After the addition of 25 μmoles of sodium thiosulfate per mole of silver halide, emulsions EM-4 to EM-6 were digested for 90 minutes at 55° C.

The spectral sensitization and stabilization of these emulsions are carried out in the same way as described in Example 1.

Photographic testing produced the sensitometric results shown in Table 2 below, the sensitivities being determined in relation to comparison emulsion EM-4.

TABLE 2

| Emulsions | O μm | E rel. | Gamma | Fogging |
|---|---|---|---|---|
| EM-4 (imidazole only; comparison) | 0.26 | 100 | 3.18 | 0.13 |
| EM-5 (iridium only; comparison) | 0.28 | 137 | 2.86 | 0.14 |
| EM-6 (imidazole + IR; invention) | 0.26 | 235 | 3.36 | 0.12 |

This comparison also clearly shows that emulsion EM-6 according to the invention has the highest sensitivity for steep gradation, its fogging being at the level of the comparison emulsions.

We claim:

1. A color photographic recording material containing color couplers and comprising at least one photosensitive silver halide emulsion layer and, optionally, other layers on a layer support, characterized in that the silver halide emulsion contains silver halide crystals with at least 20 mole-% of silver chloride and at most 80 mole-% of silver bromide of which the crystal formation and/or crystal growth were carried out in the presence of an iridium compound and an imidazole corresponding to the following formula

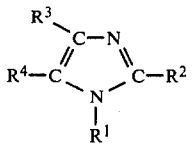

in which $R^1$, $R^2$, $R^3$ and $R^4$ may be the same or different and represent hydrogen and/or an optionally substituted alkyl, alkenyl, aryl or aralkyl group.

2. A color photographic recording material as claimed in claim 1, characterized in that the iridium compound and the imidazole were used during precipitation.

3. A color photographic recording material as claimed in claim 1, characterized in that the iridium compound is a water-soluble compound.

4. A color photographic recording material as claimed in claim 1, characterized in that the iridium compound is a hexachloroiridate.

5. A color photographic recording material as claimed in claim 1, characterized in that the imidazole is selected from the following group: imidazole, 1-methyl imidazole, 2-methyl imidazole, 1,2-dimethyl imidazole, 1-allyl imidazole, 1-methoxymethyl imidazole, 1-(2-carboxyethyl)-imidazole, 4-(or 5-) methyl imidazole, 2-ethyl-4-methyl imidazole.

6. A color photographic paper containing color couplers and comprisng at least one photosensitive silver halide emulsion layer and, optionally, other layers on a layer support, characterized in that the silver halide emulsion contains silver halide crystals with at least 20 mole-% of silver chloride and at most 80 mole-% of silver bromide of which the crystal formation and/or crystal growth were carried out in the presence of an iridium compound and an imidazole corresponding to the following formula:

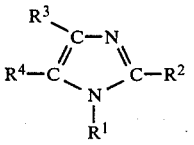

in which $R^1$, $R^2$, $R^3$ and $R^4$ may be the same or different and represent hydrogen and/or an optionally substituted alkyl, alkenyl, aryl or aralkyl group.

7. A process for the preparation of a photographic silver halide emulsion, characterized in that the silver halide crystals with at least 20 mole-% of silver chloride and at most 80 mole-% of silver bromide were prepared in the presence of an iridium compound and an imidazole corresponding to the following formula

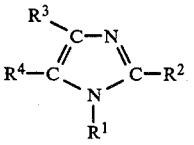

in which $R^1$, $R^2$, $R^3$ and $R^4$ may be the same or different and represent hydrogen and/or an optionally substituted alkyl, alkenyl, aryl or aralkyl group before the termination of crystal growth.

* * * * *